US009341021B2

(12) United States Patent
Lu et al.

(10) Patent No.: US 9,341,021 B2
(45) Date of Patent: May 17, 2016

(54) INTEGRATED ROLLING CURTAIN WINDOW

(71) Applicant: NINGBO XIANFENG NEW MATERIAL CO., LTD., Ningbo, Zhejiang Province (CN)

(72) Inventors: Xianfeng Lu, Ningbo (CN); Jianhua Sang, Ningbo (CN)

(73) Assignee: NINGBO XIANFENG NEW MATERIAL CO., LTD., Ningbo (CN)

( * ) Notice: Subject to any disclaimer, the term of this patent is extended or adjusted under 35 U.S.C. 154(b) by 0 days.

(21) Appl. No.: 14/326,701

(22) Filed: Jul. 9, 2014

(65) Prior Publication Data

US 2015/0152683 A1 Jun. 4, 2015

(30) Foreign Application Priority Data

Dec. 2, 2013 (CN) ..... 2013 1 0634876

(51) Int. Cl.

| | |
|---|---|
| ***A47H 1/00*** | (2006.01) |
| ***E06B 3/32*** | (2006.01) |
| ***E06B 9/42*** | (2006.01) |
| ***E06B 9/17*** | (2006.01) |
| ***E06B 9/58*** | (2006.01) |
| ***E06B 9/56*** | (2006.01) |

(52) U.S. Cl.

CPC ..... *E06B 9/42* (2013.01); *E06B 9/17007* (2013.01); *E06B 9/56* (2013.01); *E06B 9/581* (2013.01); *E06B 2009/587* (2013.01)

(58) Field of Classification Search

CPC ..... E06B 9/264; E06B 9/40; E06B 9/42; E06B 9/58; E06B 2009/588

USPC ..... 160/23.1, 266–273.1, 32, 323.1, 38, 98

See application file for complete search history.

(56) References Cited

U.S. PATENT DOCUMENTS

| | | | | |
|---|---|---|---|---|
| 1,314,221 | A * | 8/1919 | Schenck | 160/28 |
| 1,810,848 | A * | 6/1931 | Nye | 160/269 |
| 4,197,896 | A * | 4/1980 | Reichstadt | 160/107 |
| 4,757,852 | A * | 7/1988 | Jentof et al. | 160/23.1 |

(Continued)

FOREIGN PATENT DOCUMENTS

| | | | |
|---|---|---|---|
| CN | 2183437 | Y | 11/1994 |
| CN | 2353276 | Y | 12/1999 |
| CN | 2839534 | Y | 11/2006 |
| CN | 101298821 | A | 11/2008 |

(Continued)

*Primary Examiner* — Syed A Islam
*Assistant Examiner* — Jeremy Ramsey
(74) *Attorney, Agent, or Firm* — Gokalp Bayramoglu

(57) ABSTRACT

The present invention provides an integrated rolling curtain window. The integrated rolling curtain window of the invention includes a profile window. The integrated rolling curtain window further comprises a rolling curtain assembly having a window curtain cover assembly mounted on the top of the profile window, two windproof rails positioned on the front surface of both sides of the profile window, a first connection piece for removably mounting the window curtain cover assembly to the top of the profile window and a second connection piece for removably connecting the said two windproof rails to the front surface of both sides of the profile window respectively. The window curtain cover assembly has a curtain cloth component which could be rolled out and in, and both sides of the curtain cloth component move within the said two windproof rails respectively when the curtain cloth component is rolled out.

9 Claims, 16 Drawing Sheets

(56) References Cited

U.S. PATENT DOCUMENTS

| | | | | | |
|---|---|---|---|---|---|
| 4,834,164 | A | * | 5/1989 | Tuhey, Jr. | E06B 9/50 160/319 |
| 5,067,540 | A | * | 11/1991 | Besler | 160/31 |
| 5,176,194 | A | * | 1/1993 | Chigusa | 160/273.1 |
| 5,568,831 | A | * | 10/1996 | Blackwell | 160/98 |

FOREIGN PATENT DOCUMENTS

| | | | |
|---|---|---|---|
| CN | 202325171 | U | 7/2012 |
| CN | 102747945 | A | 10/2012 |
| CN | 103352638 | A | 10/2013 |
| FR | 2 529 251 | A1 | 12/1983 |

* cited by examiner

INTEGRATED ROLLING CURTAIN WINDOW

BACKGROUND OF THE INVENTION

1. Field of Invention

The present invention relates to a windproof rolling curtain window in the field of architectural components, in particular, to an integrated rolling curtain window which could be universally used and adapted to different profile windows.

2. Related Art

The window curtain is such a curtain made of cloth, bamboo, linen or plastics that could be used for shielding sunshine or adjusting the indoor light intensity. The conventional window curtains are generally mounted at the inner side of the windows or at the outer side of the windows by additionally setting a window curtain cover. The window curtain cover stands in front of the surface of the window, which destroys the overall window appearance.

A conventional window with a window curtain, for example, a multi-function rolling curtain screen window as described in the Chinese Patent Publication No. 2183437Y, includes a window cover and guide rails vertically connected to the window cover. It is shown in FIGS. 1 and 2 that the window cover is projected from the front surface of the window.

For example, a heat insulative window curtain described in the Chinese Patent Publication No. 2353276Y, includes a roll-up drum and guide rails. It is shown in FIGS. 1 and 2 that the window cover is also projected from the front surface of the window.

In order to address the problem that the window curtain has to be mounted onto the window twice and the window curtain mounted as such destroys the overall window appearance, an integrated window is disclosed in Chinese Patent Publication No. 103352638A, in which the curtain window is integrated with the window frame. In the process of installation, the integrative window curtain and window curtain is directly mounted into a preoccupied space, which addresses the problem that the widow and the window curtain have to be mounted twice. However, in such an integrated window, the window curtain could be only integrated with the window frame with a particular shape, for which the cost for replacement is increased and the convenience for maintenance of the window is decreased.

In a protection door and window having an embedded rolling curtain as disclosed in the Chinese Patent Publication No. 2839534Y, a casing is formed to conceal the rolling curtain by fixing plates in front of and beside the top of the window frame, and chute slots are disposed on both sides of the window frame, so as to address the problem that the beauty is affected by projection of the window cover from the window surface. Even though such a solution improves the beauty of the window and window cover, the window cover is till mounted on the front surface of the window as shown in FIG. 1, for which the thickness of the window is increased. When said window is mounted in a building, the thickness of the wall of the building used for mounting the original windows would be increased accordingly. Additionally, after the window and window cover are encapsulated twice, the window cover could not be conveniently removed or maintained, and the window cover can only be maintained after the encapsulation plate is dismantled.

In a novel integrated hard curtain window as disclosed in the Chinese Patent Publication No. 20235171U, the window, window cover, screen window are seamlessly integrated with each other in such a manner that they are fixedly connected. However, such a configuration imposes a strict limitation on the style of the window, window curtain and window cover, and thus largely decreases the adaptability and convenience in transportation and storage.

SUMMARY OF THE INVENTION

In order to address the aforesaid defects, the present invention provides an integrated rolling curtain window adapted to be mounted at different profile windows and will not increase the thickness of the original windows, in which the window and window curtain could be removably integrally mounted.

It is therefore an object of the present invention to provide a rolling curtain window, including a profile window. The integrated rolling curtain window further comprises a rolling curtain assembly having a window curtain cover assembly mounted on the top of the profile window, two windproof rails positioned on the front surface of both sides of the profile window, a first connection piece for removably mounting the window curtain cover assembly to the top of the profile window and a second connection piece for removably connecting the said two windproof rails to the front surface of both sides of the profile window respectively. The window curtain cover assembly has a curtain cloth component which could be rolled out and in, and both sides of the curtain cloth component move within the said two windproof rails respectively when the curtain cloth component is rolled out.

Furthermore, the window curtain cover assembly includes a cover casing, end caps covered on both sides of the cover casing, a reel pipe positioned within the cover casing and having a groove along the axial direction, a curtain cloth component having one end inserted into the groove of the reel pipe and tightened, and a transmission component mounted at both ends of the reel pipe to drive the reel pipe into rotation.

Moreover, the transmission component includes two plugs, an active wheel connection piece and a passive wheel connection piece. A through hole is formed in the middle of the plug, and a connection bar extends onto the active wheel connection piece and passive wheel connection piece and could be axially and movably fixed into the through hole of the plug.

In addition, each windproof rail includes a side rail frame having a longitudinal opening on one side facing the curtain cloth component. Two strips are symmetrically disposed on the inner sides of the side rail frame along the longitudinal direction. A spacing is formed between the said two strips facing one side of curtain cloth component. The upper end of the spacing is in communication with the window curtain cover assembly.

Moreover, a positioning element is provided within the spacing. The curtain cloth component includes flexible curtain cloth. Both side edges of the flexible curtain cloth respectively pass through the longitudinal opening of the side rail frame and the spacing between the two strips on the same side, and extend into the inner cavity of the side rail frame and are transversely placed into the positioning element.

Furthermore, the positioning element is a guide rod. The lower end of the guide rod is fixed and the upper end thereof faces right toward the interior of the window cover. Both side edges of the flexible curtain cloth respectively are covered outside of the guide rod on the same side, and could move up and down along the guide rod driven by the window curtain cover assembly.

Additionally, the positioning element is a flexible string of beads. A skirt edge is fixed to each of the side edges of the flexible curtain cloth. The skirt edges form a longitudinal space. The flexible string of beads is disposed within the longitudinal space and the diameter of the string of beads is larger than the width of the spacing between the said two strips.

Further, a lower lever is connected to the lower edge of the flexible curtain cloth. Both ends of the lower lever pass through the longitudinal opening of the side rail frame on the same side and slide up and down respectively. The length of the lower lever is adapted to the distance between the positioning elements on both sides of the flexible curtain cloth.

Moreover, the top of the profile window has an inverse T-shape groove along the axial direction. The bottom of the cover casing has a T-shape groove along the axial direction. The first connection piece is an I-shape connection piece, and the upper and bottom end faces of the I-shape connection piece are respectively inserted into the T-shape groove of the cover casing and the inverse T-shape groove of the profile window to connect the profile window with the cover casing.

Furthermore, the second connection piece is a rivet-shaped hanging post which is disposed on the inner side of the windproof rails facing to the profile window. A hole is formed on the corresponding front side surface of the profile window for inserting the rivet-shaped hanging post therein, or the rivet-shaped hanging post is disposed on the corresponding front side surface of the profile window to facilitate forming the hole for inserting the rivet-shaped hanging post on the windproof rails.

Moreover, the hole includes an insertion hole having a diameter larger than that of the rivet-shaped hanging post and elongated fixing hole having a diameter smaller than that of the cap of the rivet-shaped hanging post.

Further, the second connection piece is a hanging post which is disposed on the inner side of the windproof rails facing to the profile window; and the windproof rails are provided with a longitudinal slot corresponding to the hanging post.

Moreover, the cover casing includes a housing of a rectangular section formed by a cover top, a cover bottom, an outer cap and an inner cap. The contact surface of the end cap with the end face of the cover casing has a sealing groove thereon and a sealing strip mounted within the sealing groove. The cover top and cover bottom have a sealing groove along the axial direction and a sealing strip mounted within the sealing groove.

Moreover, the integrated rolling curtain window further comprises end cap connection pieces. The end caps are provided with grooves for containing the end cap connection pieces. The end cap connection pieces are partially fixedly connected to the grooves and partially fixedly connected to the side of the profile window.

It is another object of the present invention to provide another rolling curtain window, including a profile window. The integrated rolling curtain window further comprises a rolling curtain assembly having a window curtain cover assembly mounted on the top of the profile window, windproof rails positioned on the front surface of both sides of the profile window, a first connection piece for removably mounting the window curtain cover assembly to the top of the profile window and a second connection piece for removably connecting the said windproof rails to the front surface of both sides of the profile window respectively. The side of the windproof rails facing to the curtain cloth component is provided with at least two longitudinal openings. Two strips are symmetrically provided within each longitudinal opening along the longitudinal direction. A spacing is formed between the said two strips facing to one side of the curtain cloth component. The upper end of the spacing is in communication with the window curtain cover assembly. The window curtain cover assembly is provided with at least two curtain cloth components which could be rolled out and in corresponding to the longitudinal openings of the windproof rails. Both sides of the curtain cloth component move within the corresponding longitudinal openings respectively when each of the curtain cloth components is rolled out.

Furthermore, each curtain cloth component includes flexible curtain cloth, and the flexible curtain cloth for different curtain cloth components achieves different functions.

Moreover, the top of the profile window has an inverse T-shape groove along the axial direction. The bottom of the cover casing has a T-shape groove along the axial direction. The first connection piece is an I-shape connection piece, and the upper and bottom end faces of the l-shape connection piece are respectively inserted into the T-shape groove of the cover casing and the inverse T-shape groove of the profile window to connect the profile window with the cover casing.

Further, the second connection piece is formed by a hanging post and a hole for inserting the hanging post therein. The hanging post and hole are disposed on opposite faces of the corresponding windproof rail. The hanging post and hole are further disposed on the front surface of the profile window and the inner side of the profile window corresponding to the windproof rail.

Furthermore, the second connection piece is formed by a hanging post and a longitudinal slot. The hanging post and longitudinal slot are disposed on opposite faces of the corresponding windproof rail. The hanging post is further disposed on the front surface of the profile window and the longitudinal slot is disposed on the inner side of the profile window corresponding to the windproof rail.

It is the other object of the present invention to provide another rolling curtain window, including a profile window. The integrated rolling curtain window further comprises a rolling curtain assembly having a window curtain cover assembly mounted on the top of the profile window, two front windproof rails positioned on the front surface of both sides of the profile window, two back windproof rails positioned on the back surface of both sides of the profile window, a first connection piece for removably mounting the window curtain cover assembly to the top of the profile window and a second connection piece for removably connecting the said front and back windproof rails to the front and back surfaces of both sides of the profile window respectively. The window curtain cover assembly is provided with front and back curtain cloth components which could be rolled out and in, and both sides of the front and back curtain cloth components move within the corresponding front and back windproof rails respectively when the front and back curtain cloth components are rolled out.

Compared with the prior an, the invention has the following advantages.

First, the window is integrated with the window curtain and could be adapted to the existing profile windows of various different shapes, for which there is no need to make huge alterations to the existing profile windows. In the process of building architecture, the integrated window of the invention could be directly mounted to the previously reserved window installation hole. The window thus obtained not only has the function of ordinary windows, but also has the function of the window curtain. To this end, there is no need to additionally install the window curtain and the outer wall of the whole architecture will be of more aesthetic appearance.

Second, the window cover could be removably disposed at the top of the original profile window. The thickness of the integrated window being mounted is substantially the same as that of the original profile window, for which there is no need to change the design for the window installation hole previously reserved window installation hole.

Third, the removable mounting mode facilitates subsequent maintenance and assembly.

Fourth, the sealing groove and sealing strips will improve air tightness, water tightness and sound tightness of the integrated window.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Embodiments of the present invention will be described in detail below with reference to the drawings. However, the present invention shall not be limited to these embodiments.

As shown in FIGS. 1-6, the integrated rolling curtain window of the invention includes a window curtain cover assembly, a windproof rail 2, a first connection piece and a second connection piece, as well as a profile window 5. The profile window 5 could be of an internal-open type, external-open type or a push-pull type, and the profile could be aluminum alloys, wood or iron, to name a few here.

The window curtain cover assembly is removably mounted on the top of the profile window 5 through a first connection piece. As a result, the window curtain cover assembly according to this invention could be mounted at any type of profile window 5, and could be repeatedly removed and mounted to meet demands of different window curtains.

Figure 1:
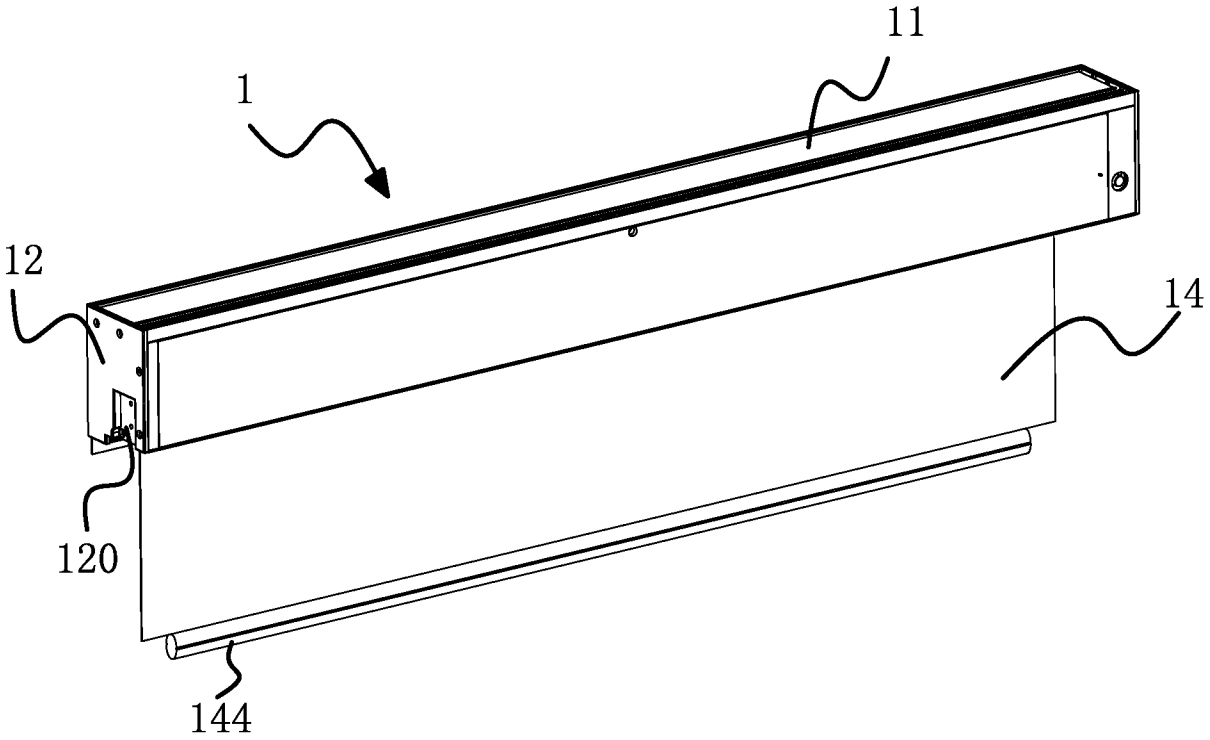
FIG. 1 is a holistic schematic view of the rolling curtain assembly in the integrated rolling curtain window of the invention.
Figure 2:
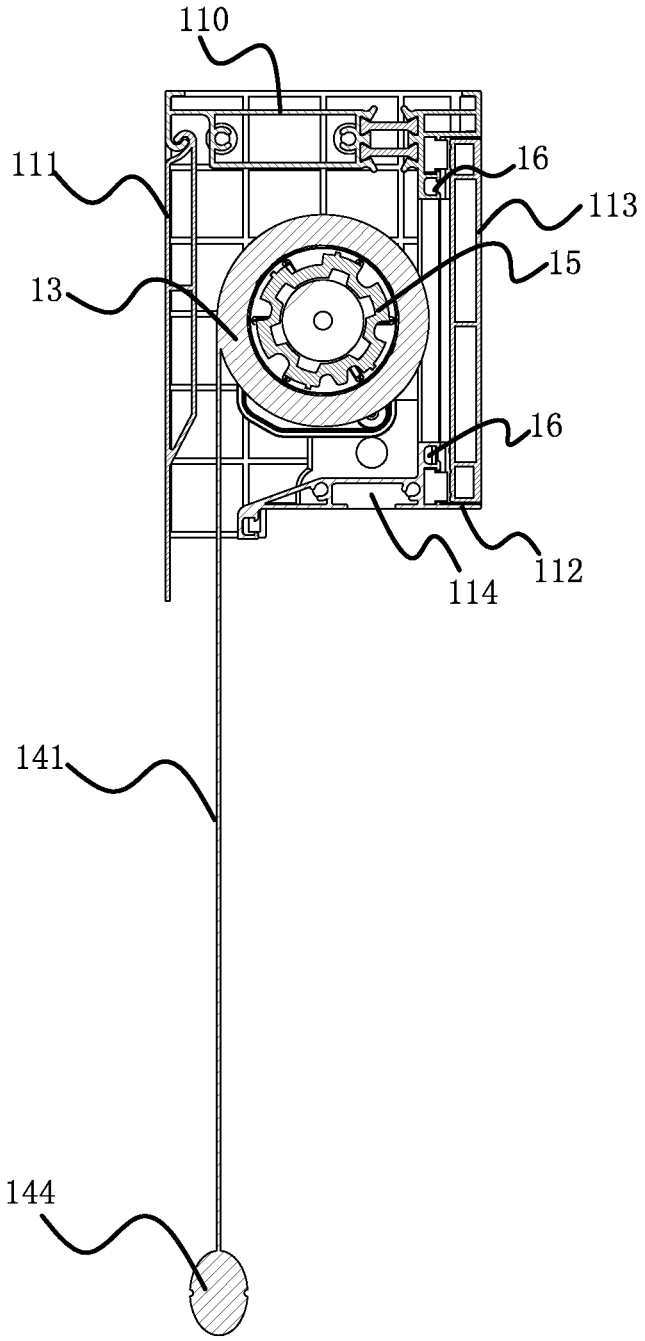
FIG. 2 is a section view of the rolling curtain assembly of FIG. 1.
Figure 3:
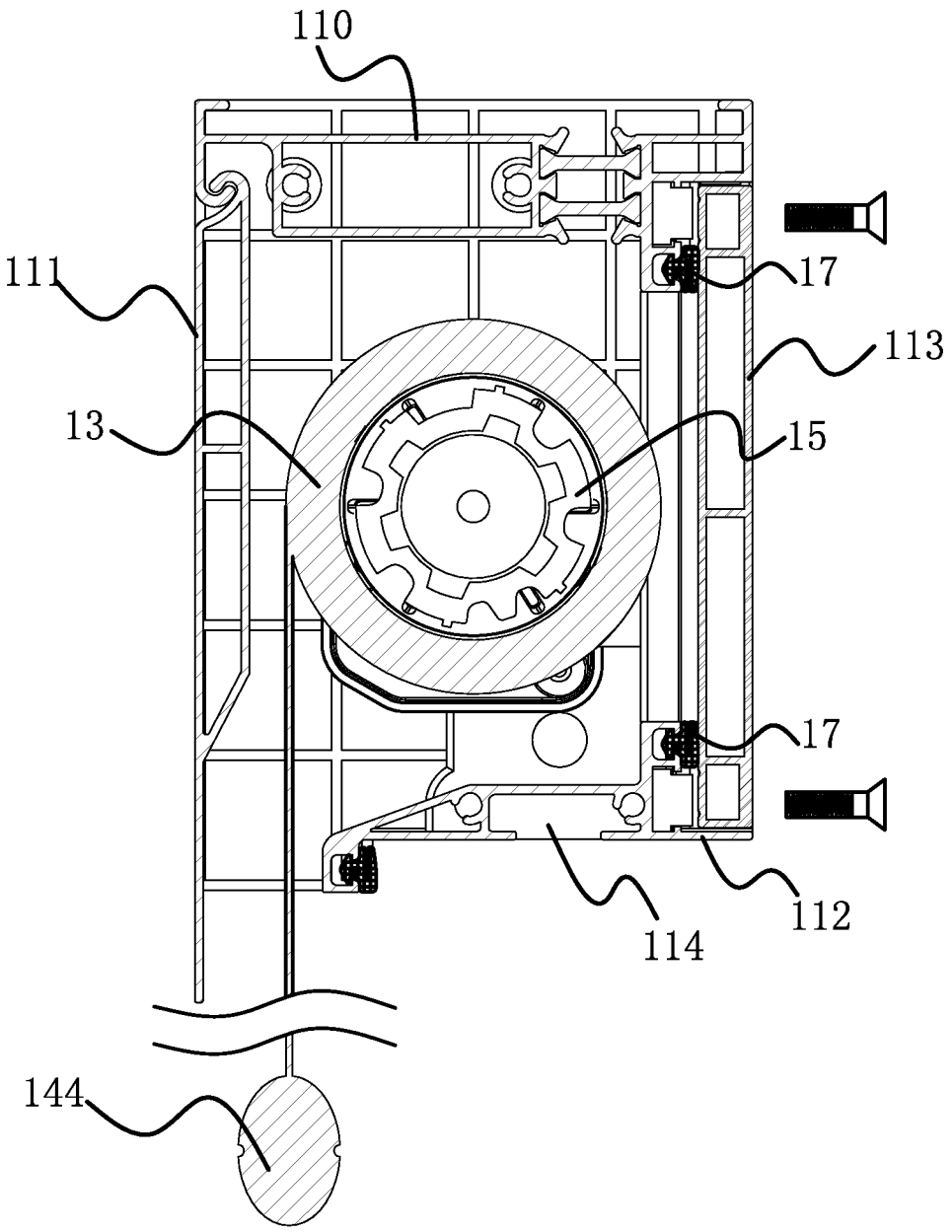
FIG. 3 is a section view of the rolling curtain assembly of FIG. 2 after being provided with a sealing strip.
Figure 7A:
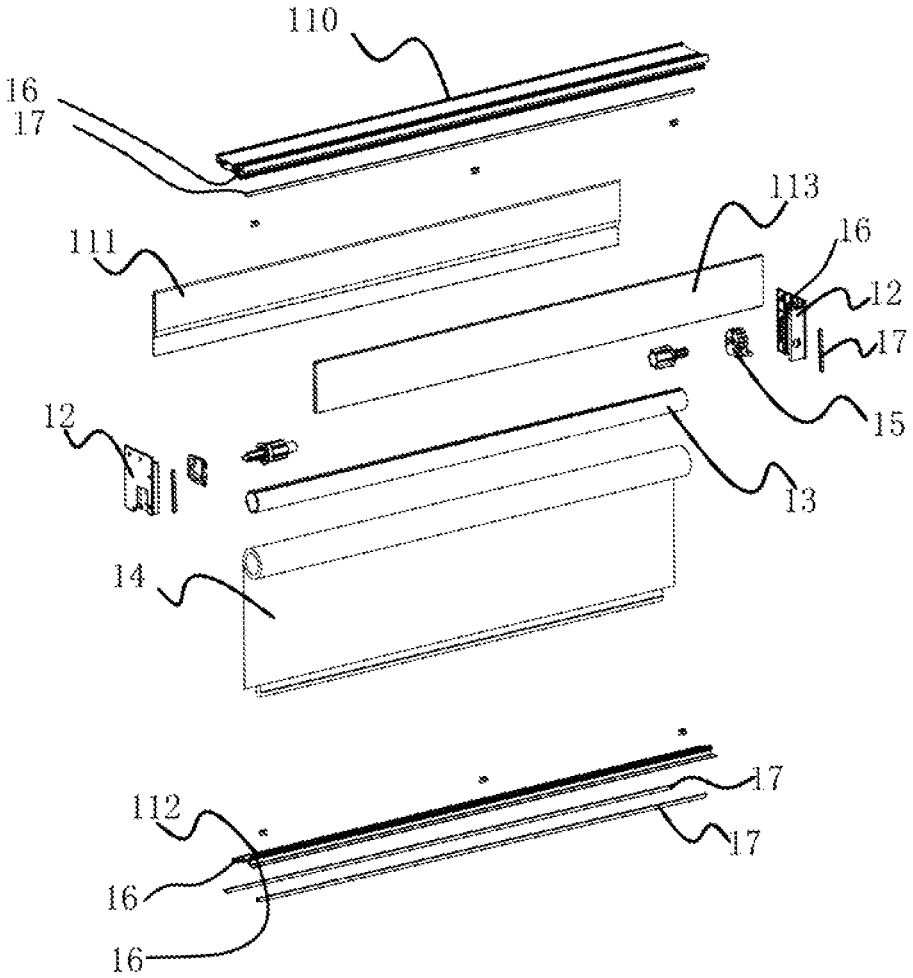
FIG. 7*a* is an exploded view of the parts of the rolling curtain assembly of FIG. 1.
Figure 7B:
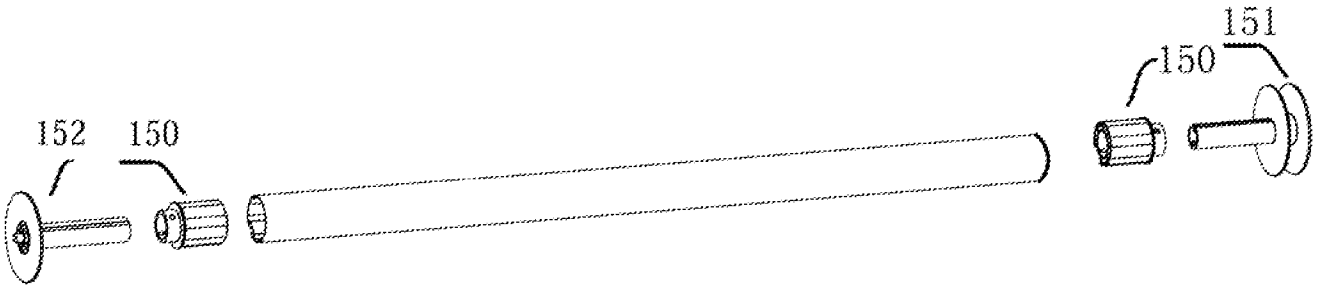
FIG. 7*b* is an exploded view of the parts of the transmission component in another embodiment.

As shown in FIGS. 2, 3 and 7, the window curtain cover assembly comprises a cover casing 11, end caps 12, a reel pipe 13, a curtain cloth component 14 and a transmission component 15.

The cover casing 11 is used to contain other parts, including a cover top 110, an outer cap 111, a cover bottom 112 and an inner cap 113, every two of which are connected and engaged with each other to form a rectangular housing. The end cap 12 is used to cover both end faces of the housing to form a sealed space. In order to achieve good air tightness, water tightness and sound tightness. As shown in FIG. 3, a sealing groove 16 is disposed in the axial direction on the partial surface of the cover top 110 engaged with the inner cap 113, and a sealing strip 17 is mounted within the sealing groove 16 and could be made of rubber or plastics. Similarly, a sealing groove 16 is disposed in the axial direction on the partial surface of the cover bottom 112 engaged with the profile window 5, and a sealing strip 17 is mounted within the sealing groove 16. Moreover, a sealing groove 16 could be disposed on the contact surface of the end cap 12 with the end face of the cover casing 11, and a sealing strip 17 is mounted within the sealing groove 16. Such a configuration of the sealing grooves 16 and sealing strips 17 could not only make each part tightly connected with each other and provide a buffering effect, but also achieve good air tightness, water tightness and sound tightness.

A reel pipe 13 is mounted within the cover casing 11. The reel pipe 13 is provided with a groove along its axial bus bar, and both ends thereof are connected to the end cap 12 through the transmission component 15. One end of the curtain cloth component 14 is inserted into the groove and fixed thereto tightly, and the other end thereof passes through the groove at the bottom of the cover casing and hangs under the cover casing 11. When an electric motor is used as the power source for transmission, the transmission component 15 could be an electric motor or gear transmission gear mechanism; and when the roll-up and roll-down of the curtain cloth are manually driven, the transmission component 15 could have a rocker, a universal joint and the like. The specific elements of the transmission component 15 are not limited in this invention, as long as the reel pipe 13 could be rolled by an external force to roll up or down the curtain cloth component 14.

Preferably, for convenience of removal, the transmission component 15 has two plugs 150, an active wheel connection piece 151 and a passive wheel connection piece 152; a through hole is formed in the middle of the plug 150, and a connection bar extends onto each of the active wheel connection piece 151 and passive wheel connection piece 152 and could be axially and movably fixed into the through hole of the plug 150. When the active and passive wheels need be removed, the active and passive connection bars axially move within the plugs 150, and are connected to or detached from active and passive wheels, and thus being mounted and removed rapidly.

Figure 4:
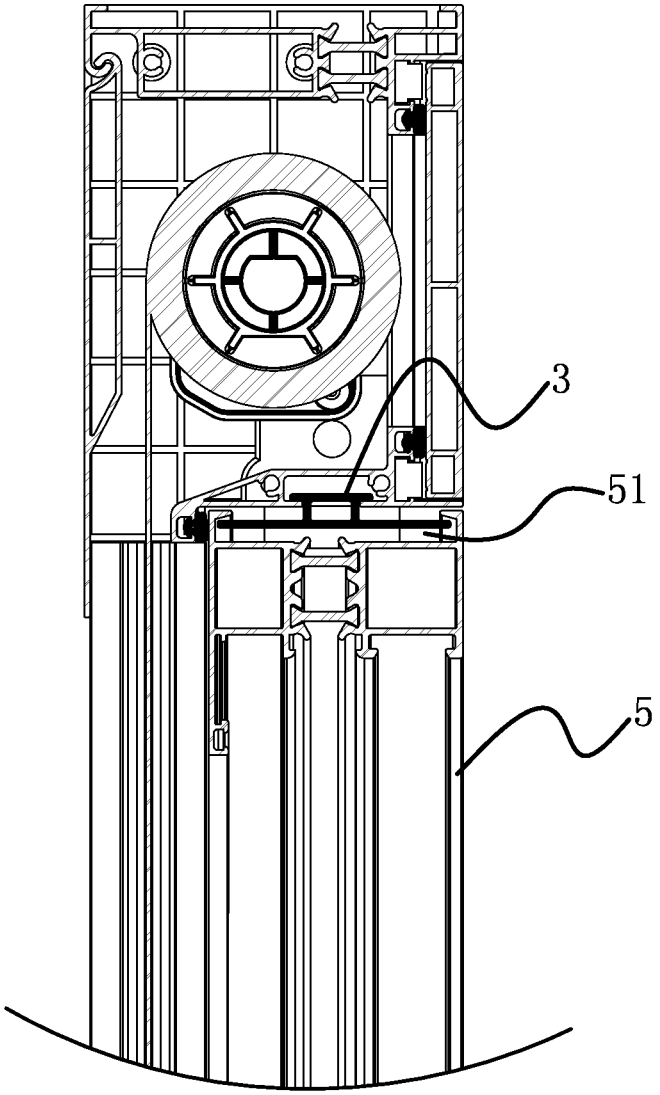
FIG. 4 is a structural diagram of the rolling curtain assembly of FIG. 3 after being mounted onto the profile window.

The window curtain cover assembly is removably mounted onto the profile window 5 through the first connection piece. In this embodiment, the first connection piece includes an I-shape connection piece 3 and end cap connection pieces 4. As shown in FIG. 4, the cover bottom 112 has a T-shape groove along the axial direction, and the top of the conventional profile window 5 generally has a T-shape groove 51 along the axial direction. In such an embodiment, the I-shape connection piece 3 in the first connection piece has a length extending the axial direction and a cross section of a similar I-shape.

Figure 6:
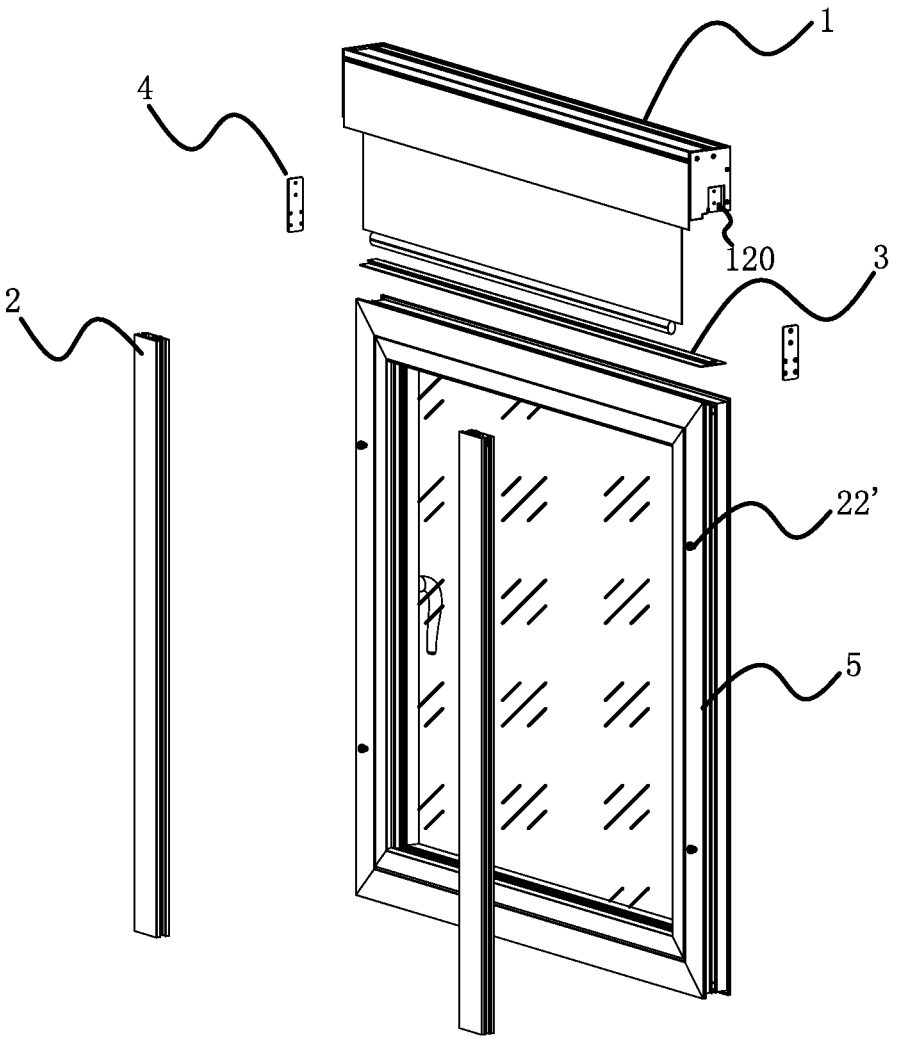
FIG. 6 is an exploded view of the integrated rolling curtain window of the invention.

As shown in FIGS. 4 and 6, while being mounted, the upper end face of the I-shape connection piece 3 is inserted into the T-shape groove 114 of the cover bottom 112 and the lower end face thereof is inserted into the inverse T-shape groove 5 of the profile window 5, for which the profile window 5 is connected with the cover casing 11. By using such a configuration, the I-shape connection piece 3 is fixed to the top of the profile window by slidable engagement, and the window curtain cover assembly is fixed to the I-shape connection piece 3 by slidable engagement. Thereafter, both ends of the I-shape connection piece 3 are covered by the end cap connection pieces 4 and pressed against the sides at both ends of the top of the profile window 5, so that transverse movement of the whole window curtain cover assembly is restricted. When the I-shape connection piece 3 needs to be removed, the end cap connection pieces 4 are removed and the I-shape connection piece is drawn out along the axial direction.

The end caps 12 are mounted at both ends of the window curtain cloth assembly and are provided with a groove on the surface. The end cap connection pieces 4 are mounted into the grooves 120 and secured by bolts. The grooves are formed on the outer surface of the end caps 12 to exactly mount the end cap connection pieces 4 into the grooves. To this end, the appearance is kept flat and the structure looks more compact and aesthetic.

The profile window 5 is connected with the window curtain cover assembly by using the I-shape connection piece 3 and end cap connection pieces 4, which provides a simple structure and easy removal and installation. Furthermore, such a connection imposes no limitation upon the profile window 5 for the following reasons. Generally speaking, an inverse T-shape groove 51 is set on the top of the conventional profile windows 5. When there is no T-shape on the top of a portion of particular profile windows, an additional inverse T-shape groove is formed or a top plate having an inverse T-shape groove 51 is fixed on the top of the profile window 5 by using a bolt or adhesive. This way, the window curtain cover assembly can be removably mounted and has a wide application.

Furthermore, in order to enhance the windproof performance of the curtain cloth 141, the curtain cloth component 14 according to this embodiment not only has curtain cloth 141, but also has skirt edges 142, positioning elements and a lower lever 144. The positioning elements are preferred to be flexible string beads. Accordingly, the window curtain assembly according to this invention further includes windproof rails 2.

Figure 5:
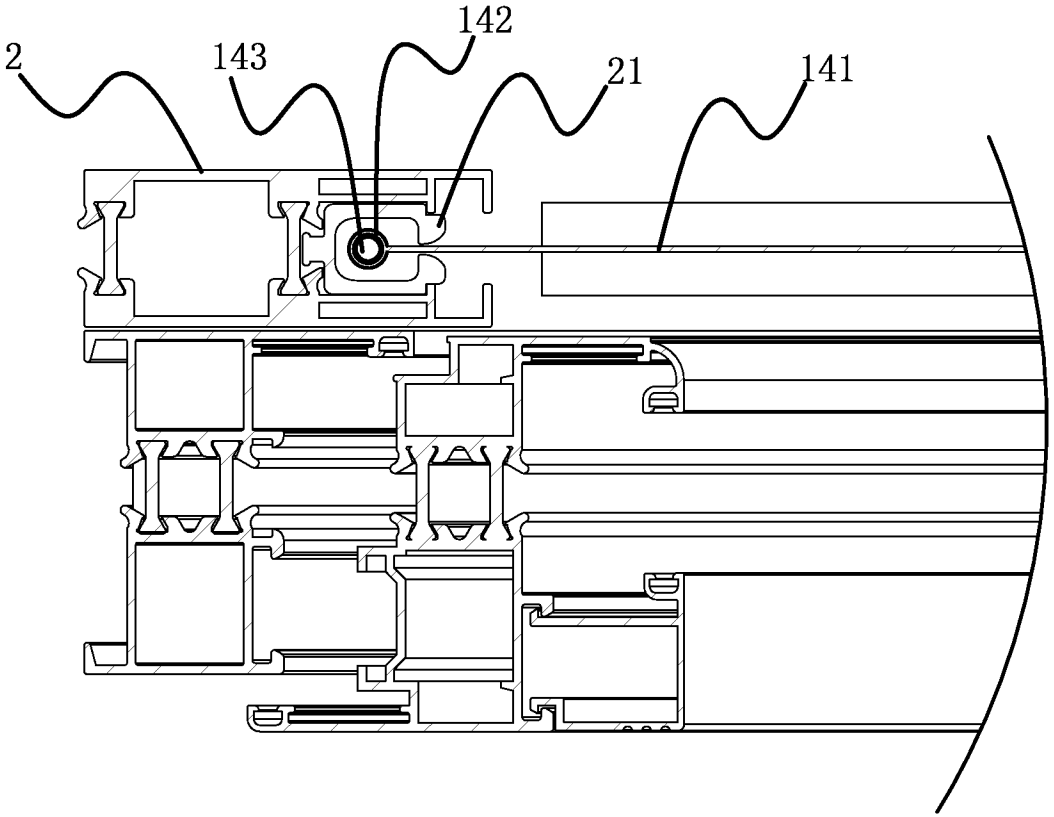
FIG. 5 is a top section view of windproof rails of the rolling curtain assembly.

As shown in FIG. 5, a windproof rail 2 is mounted on each side of the window curtain cover assembly, and the top end of each windproof rail 2 is fixed to the front surface on both sides of the profile window 5 through the second connection piece. In this embodiment, each windproof rail 2, as shown in FIG. 5, includes a side rail frame having a longitudinal opening on one side facing the curtain cloth component 14. Two strips 21 are disposed on the inner sides of the longitudinal opening, which are separated by a certain distance and form a spacing. The spacing is right opposite to the longitudinal opening. The inner sides of the said two strips 21 correspond to the inner cavity of the side rail frame. Also, the upper end of the spacing between the inner cavity and the strip 21 is in communication with the elongated slot for hanging the curtain cloth component 14 under the cover casing 11 of the window curtain cover assembly.

With reference to FIGS. 10*a*, 10*b*, 10*c* and 10*d*, the curtain cloth component 14 has a whole piece of curtain cloth 141, and the skirt edges 142 are mounted on both sides of the curtain cloth 141, which are made from a material identical to or different from that of the curtain cloth 141. The skirt edges 142 are stitched or welded opposite to each other along the longitudinal direction, to form a longitudinal space. A flexible string of beads 143 is mounted within the longitudinal space in the longitudinal direction. The beads of the flexible string are arranged at a certain spacing, and the diameter of the beads is larger than the width of the spacing between the said two strips 21.

Therefore, when the curtain cloth component 14 is rolled out, it hangs down within the elongated slot of the cover bottom 112, the skirt edges 142 and flexible string of beads 143 on both sides fall into the inner cavity of the side rail frame on the corresponding side, and the curtain cloth 141 passes through the spacing between two strips 21 and the longitudinal opening.

As the diameter of the flexible string of beads 143 is larger than the spacing of the strips 21, the skirt edges 142 are led to be restricted by the flexible string of beads 143 and will not exit from the spacing between the strips 21. When the wind is strong, the skirt edges 142 on both sides could always be kept flattened and will not arbitrarily flow, for which the windproof performance is enhanced. Furthermore, in order to improve the flatness, the lower lever 144 is mounted at the lower end of the curtain cloth 141. Both ends of the lower lever respectively pass through the longitudinal opening of the rail frame on the same side and extend into the spacing formed between both strips by sliding up and down. The length of the lower lever is adapted to the distance between the positioning elements at both sides of the flexible curtain cloth.

The flatness of the curtain cloth component 14 in operation could be improved by increasing the windproof rails 2, which could provide a more aesthetic effect in use and continue to work even when the wind is strong.

In another embodiment, the positioning element could be a guide rod, the lower end of which is fixed and the upper end of which faces toward the interior of the window cover. When the curtain cloth is rolled out, the skirt edges on both sides of the curtain cloth cover on the guide rod from the top of the guide rod. As the outer diameter of the guide rod is larger than the distance between two strips in the windproof rail, the curtain cloth will not fall out of the windproof rails of the window curtain when the curtain cloth is subject to wind pressure. The skirt edges on both sides of the flexible curtain cloth are respectively covered on the outside of the guide rod on the same side and could move up and down along the guide rod driven by the window curtain cover assembly.

Even though the curtain cloth could be prevented from falling out of the windproof rails even subject to wind pressure by using the guide rod as the positioning element, the curtain cloth, while being rolled in, is wound around the reel pipe to flatten the tubular skirt edges, and while the curtain cloth is rolled out, the top of the guide rod could not push off the skirt edges. Consequently, two phenomena would occur. First, the guide rod pierces through the skirt edges and the curtain cloth flows out of the windproof rails of the window curtain. Second, as the guide rod has a small diameter and a large length to make the guide rod naturally bend, the top of the guide rod is pressed against the inner wall of the windproof rails, and the skirt edges on both sides of the curtain cloth pile up within the windproof rails and could not move. To this end, the curtain cloth could not be rolled out. These two phenomena tend to occur when the window curtain is subject to wind pressure or the speed for manual operation is uneven in the manual mechanism.

The flexible string of beads is formed by connecting a multiple of circular beads of the same diameter in series at the same distance. The flexible string of beads is fixed into the skirt edges on both sides of the curtain cloth and integrated with the curtain cloth. As the windproof element and the flexile string of beads are integrated with the curtain cloth, the curtain cloth will not be caused by the windproof elements to be unable to roll out even when the window curtain is subject to wind pressure or the speed for manual operation is uneven in the manual mechanism. Meanwhile, the windproof element will not pierce through the skirt edges of the curtain cloth to flow the curtain cloth out of the windproof rails of the window curtain. Therefore, the flexible string of beads is preferably used as the positioning elements in this application.

Figure 8A:
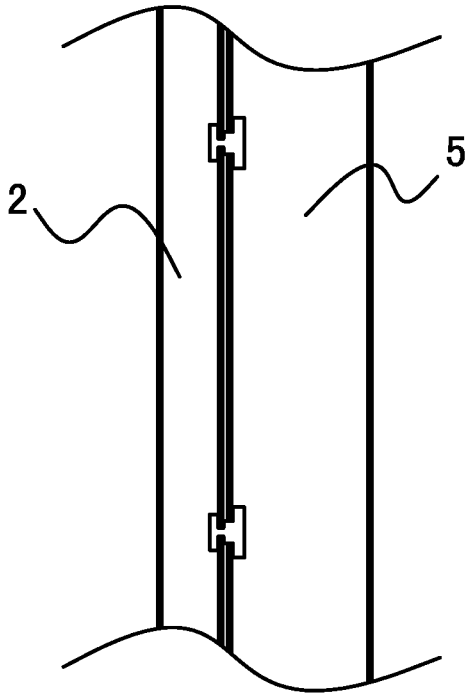
FIG. 8*a* is a diagram of the windproof rail being hung onto the profile window by a rivet-shaped hanging post.
Figure 8B:
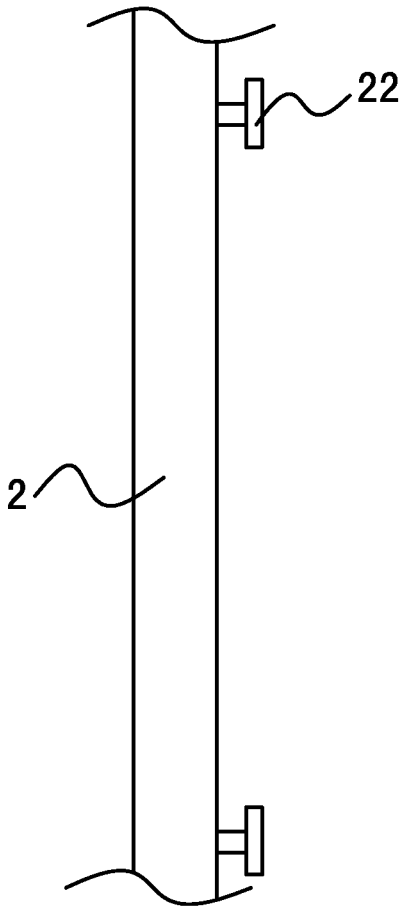
FIG. 8*b* is a side view of the windproof rail of FIG. 8*a;*
Figure 8C:
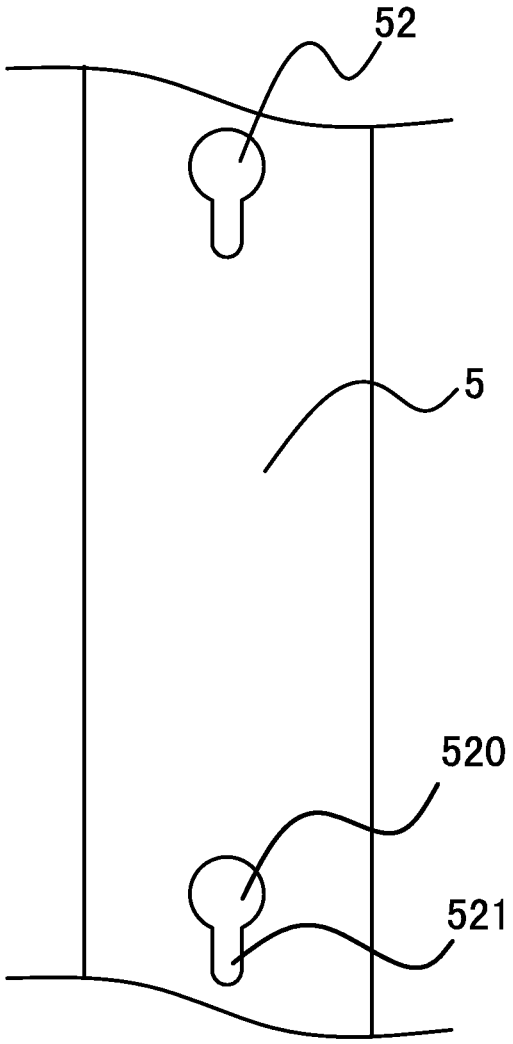
FIG. 8*c* is a front view of the profile window of FIG. 8*a;*

The second connection piece is used to removably connect the windproof rails 2 to the front surface of both sides of the profile window 5. In one embodiment, as shown in FIGS. 8*a*, 8*b* and 8*c*, the second connection piece is a rivet-shaped hanging post 22 which is disposed on the inner side of the windproof rails 2 facing to the profile window 5. A hole 52 is formed on the corresponding side surface of the profile window 5 for inserting the rivet-shaped hanging post therein. The stability of the structure could be improved by the cooperation of the hanging post with the hole, and falls could be prevented. Obviously, the position of the rivet-shaped hanging post 22 and that of the hole 52 could be exchanged. That is to say, the rivet-shaped hanging post 22 is disposed on the corresponding front side surface of the profile window 5 and the hole 52 for inserting the rivet-shaped hanging post 22 therein is formed on the windproof rails.

Specifically, the hole 52 includes an insertion hole 520 having a diameter larger than that of the rivet-shaped hanging post and elongated fixing hole 521 having a diameter smaller than that of the cap of the rivet-shaped hanging post. The hanging post is inserted into the insertion hole 520 and than engaged into the elongated fixing hole 521.

By means of the cooperation of the rivet-shaped hanging post 22 with the hole 52, a simple structure and convenient operation could be achieved. The user may hang the windproof rails 2 onto the profile window 5 easily, for which removal and mounting are quite simple.

Figure 9:
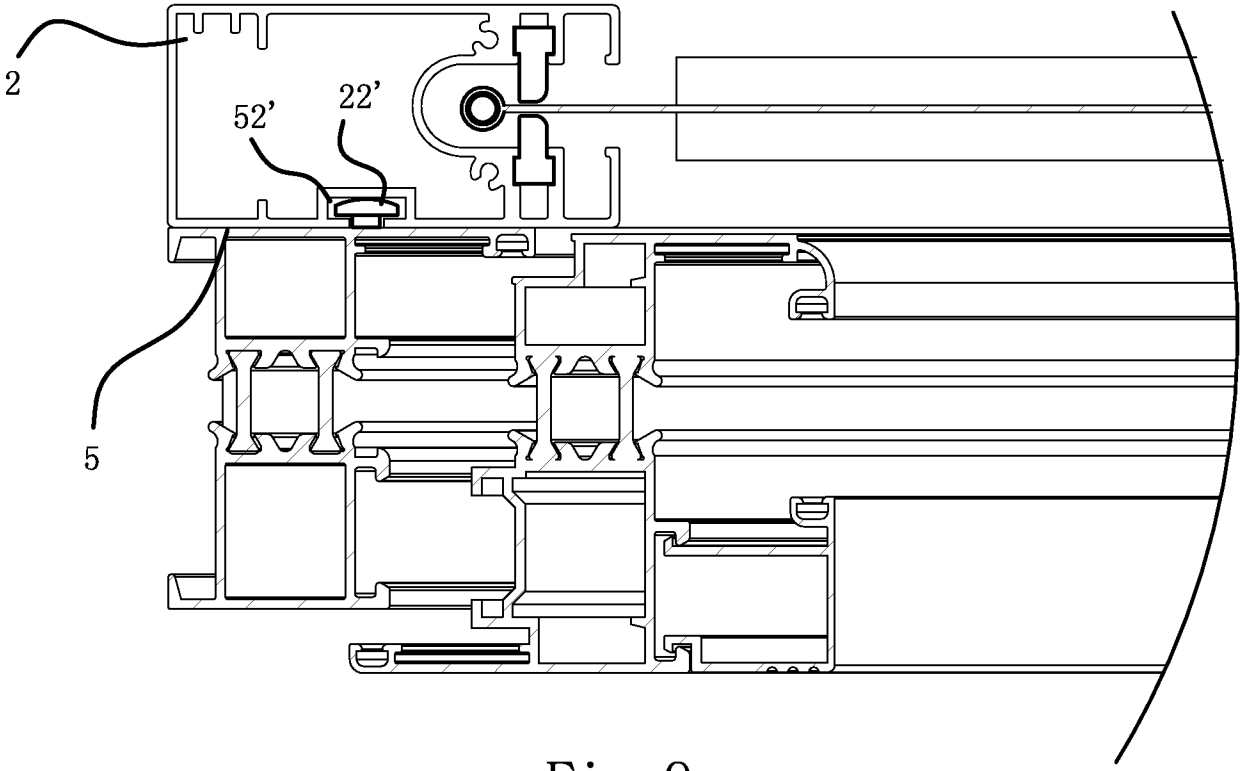
FIG. 9 is a partial section view of the windproof rails being removably fixed to the profile according to another embodiment of the invention.
Figure 10A:
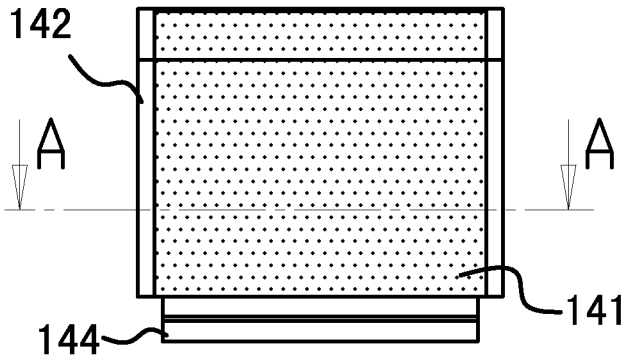
FIG. 10*a* is a front view of the curtain cloth component of FIG. 1.
Figure 10B:
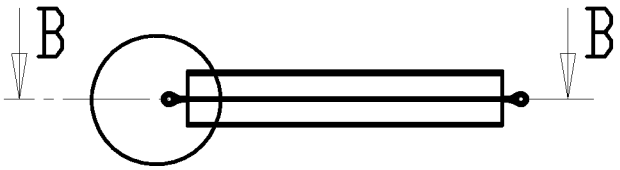
FIG. 10*b* is a section view along A-A of FIG. 10*a;*
Figure 10C:
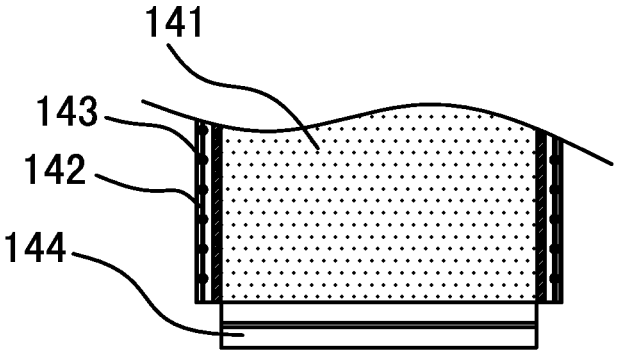
FIG. 10*c* is a section view along B-B of FIG. 10*a;*
Figure 10D:
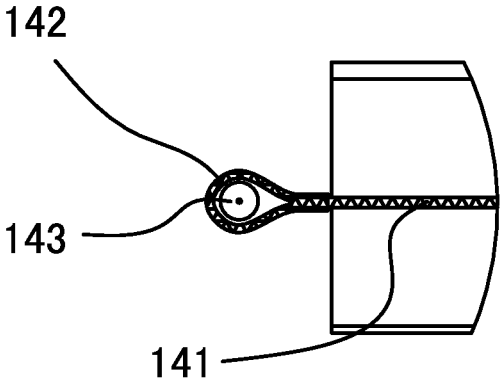
FIG. 10*d* is a partial enlarged view of FIG. 10*b;*
Figure 11B:
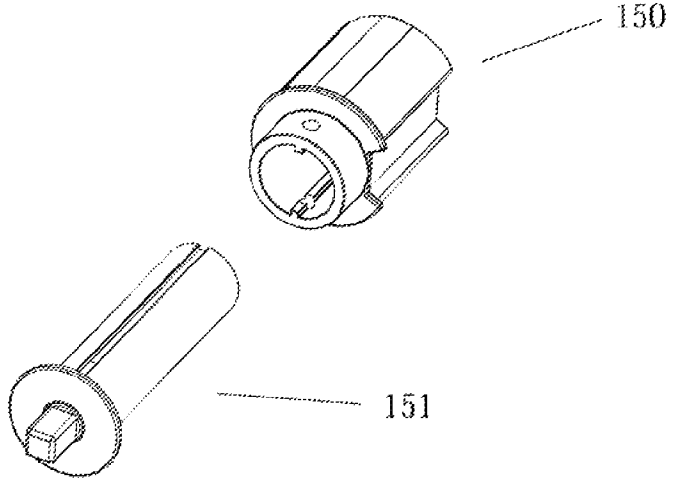
FIG. 11*b* shows one of the plugs and the active wheel connection piece of the transmission component of the window curtain cover assembly according to an embodiment of the invention.
Figure 11A:
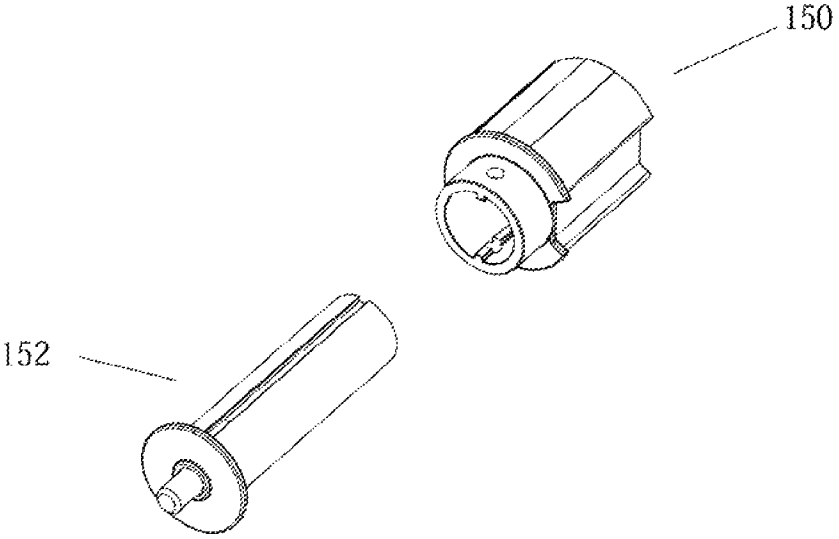
FIG. 11*a* shows one of the plugs and the passive wheel connection piece of the transmission component of the window curtain cover assembly according to an embodiment of the invention.
Figure 12:
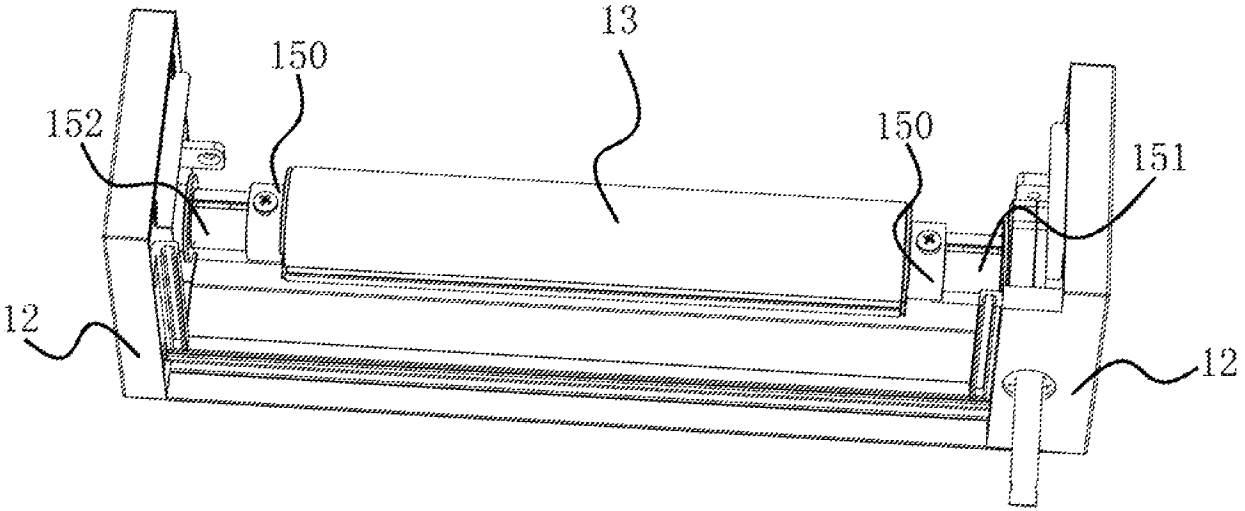
FIG. 12 is an underside of the window curtain cover assembly according to an embodiment of the invention.

In another embodiment, as shown in FIG. 9, the second connection piece is a rivet-shaped hanging post 22' which is disposed on the front side surface of the profile window 5. A longitudinal slot 52' is formed on the windproof rails 2 corresponding to the rivet-shaped hanging post 22'. The hanging post 22' is fixed into the longitudinal slot 52' so that the windproof rails 2 are removably connected with the profile window 5.

Certainly, the second connection piece could be other means, like bolt connection or adhesion, which shall not be limited herein.

In summary, the rolling curtain assembly of the invention has the advantages including good universality, simple installation and adaptability to various profile windows 5. Moreover, the air tightness, water tightness and sound tightness of the rolling curtain assembly could be improved by the sealing groove 16 and sealing strip 17. By using the first and second connection pieces, the window curtain cover assembly 1, windproof rails 2 and profile window 5 could be removably connected to each other, thus providing a more flexible structure and repeated use in different circumstances.

The present invention further provides another integrated rolling curtain window, which is different from the aforesaid integrated curtain window in that at least two gaps for containing the curtain cloth are provided on the windproof rails and correspondingly, at least two curtain cloth components are disposed within the window curtain cover assembly.

After at least two curtain cloth components are provided, the curtain cloth of different functions could be respectively disposed within the said two curtain cloth components. For example, one layer of the curtain cloth could be for shielding sunshine and the other layer could be for preventing mosquito. As such, the functions of sunshine shielding and mosquito prevention are combined into one piece and the curtain cloth could be used both in daytime and night.

The present invention further provides another integrated rolling curtain window, which is different from the aforesaid integrated curtain window in that windproof rails are provided on both the front and back surfaces on both sides of the profile window, and curtain cloth components are respectively disposed within the window curtain cover assembly corresponding to the windproof rails on the front surface and back surface.

The windproof rails on the front and back surfaces are connected with the front surface and back surface on both sides of the profile window in a manner similar to the second connection piece.

In the said integrated rolling curtain window, window curtain could be provided on the inner and outer sides of the window. The user could set the functions of the inner and outer window curtain based on his/her selection, for example the inner curtain being used for shielding sunshine, the inner curtain being used for preventing mosquito, or the outer and inner curtain both being used for shielding sunshine.

The specific embodiments described herein are merely illustrative of the spirit of the invention. It is apparent to those skilled in the art that various modifications, amendments and alternatives can be made to these embodiments without departing from the spirit or scope defined by the appended claims.

Even though terms for example rolling curtain, sealing, cover casing and curtain cloth are used herein, the other terms could also be used. The use of these terms is merely to describe and explain the essence of the invention more conveniently. It is a departure from the spirit of the invention to construe these terms as an additional limitation.

The invention claimed is:

1. An integrated rolling curtain window, comprising:

a profile window, a rolling curtain assembly; wherein the rolling curtain assembly comprises a window curtain cover assembly mounted on a top of the profile window, two rails positioned on both sides of a front surface of the profile window, a first connection piece for removably mounting the window curtain cover assembly to the top of the profile window, and two second connection pieces for removably connecting the two rails to both sides of the front surface of the profile window respectively; wherein the window curtain cover assembly comprises a cover casing, two end caps respectively removably covered on both sides of the cover casing, a reel pipe positioned within the cover casing and having a groove along an axial direction, a curtain cloth component configured to be rolled out and in, and both sides of the curtain cloth component move within the two rails respectively when the curtain cloth component is rolled out, and a transmission component mounted at both ends of the reel pipe to drive the reel pipe into rotation;

wherein the first connection piece comprises an I-shaped connection piece and an endcap connection piece;

wherein the too of the profile window has an inverse T-shape groove along the axial direction, a bottom of the cover casing has a T-shape groove along the axial direction, and upper and bottom end faces of the I-shape connection piece are respectively inserted into the T-shape groove of the cover casing and the inverse T-shape groove of the profile window to connect the profile window with the cover casing;

wherein a surface of each end cap comprises a concave structure for containing the endcap connection piece, so that the endcap connection piece is partially connected to the concave structure and partially connected to a side of the profile window;

wherein an end of the curtain cloth component is inserted into the groove of the reel pipe and tightened;

wherein the transmission component comprises two plugs, an active wheel connection piece and a passive wheel connection piece; a through hole is formed in a middle of each of the plugs, and two connection bars extend onto the active wheel connection piece and the passive wheel connection piece respectively and are configured to be axially and movably fixed in the respective through holes of the plugs.

2. The integrated rolling curtain window as claimed in claim 1, wherein each rail comprises a side frame having a longitudinal opening on one side facing the curtain cloth component, a pair of strips is symmetrically disposed on inner sides of each side rail frame along the longitudinal direction, a spacing is formed between each pair of strips, and an upper end of each spacing is in communication with the window curtain cover assembly.

3. The integrated rolling curtain window as claimed in claim 2, wherein each side of the curtain cloth component passes through both the longitudinal opening of the corresponding side rail frame and the spacing between the corresponding pair of strips and extends into an inner cavity of the corresponding side rail frame when the curtain cloth component is rolled out.

4. The integrated rolling curtain window as claimed in claim 3, wherein a positioning element is provided within the spacing, the curtain cloth component comprises a flexible curtain cloth, both side edges of the flexible curtain cloth respectively pass through the longitudinal opening of the side rail frame and the spacing between the two strips on the same side, and extend into the inner cavity of the side rail frame and are transversely placed into the positioning element.

5. The integrated rolling curtain window as claimed in claim 4, wherein the positioning element is a flexible string of beads, a skirt edge is fixed to each of the side edges of the flexible curtain cloth, the skirt edges form a longitudinal space, the flexible string of beads is disposed within the longitudinal space and the diameter of the string of beads is larger than the width of the spacing between the said two strips.

6. The integrated dolling curtain window as claimed in claim 1, wherein the second connection piece is a hanging post which is disposed on an inner side of the rails facing to the profile window; and the rails are provided with a longitudinal slot corresponding to the hanging post.

7. The integrated rolling curtain window as claimed in claim 6, wherein the hanging post comprises a smooth cylindrical shaft with a head on one end and disposed on an inner side of the rail facing the profile window, a hole is formed on a corresponding front side surface of the profile window to receive the hanging post therein, or the hanging post is disposed on the corresponding front side surface of the profile window to facilitate forming the hole to receive the hanging post on the rails.

8. The integrated rolling curtain window as claimed in claim 7, wherein the hole includes an insertion hole having a diameter larger than that of the hanging post and an elongated fixing hole having a diameter smaller than that of a cap of the hanging post.

9. The integrated rolling curtain window as claimed in claim 1, wherein the cover casing includes a housing of a rectangular section formed by a cover top, a cover bottom, an outer cap and an inner cap, a surface of the end cap contacts an end faces of the cover casing that has a sealing groove thereon and a sealing strip mounted within the sealing groove; each of the cover top and cover bottom has a sealing groove along the axial direction and a sealing strip mounted within the sealing groove.

* * * * *